US005647755A

United States Patent [19]

Hida et al.

[11] Patent Number: 5,647,755

[45] Date of Patent: Jul. 15, 1997

[54] ELECTRICAL CONNECTOR

[75] Inventors: Masato Hida; Sadao Kuboi, both of Tokyo, Japan

[73] Assignee: DDK Ltd., Japan

[21] Appl. No.: 602,954

[22] Filed: Feb. 16, 1996

[30] Foreign Application Priority Data

Mar. 1, 1995 [JP] Japan ..... 7-066818

[51] Int. Cl.[6] ..... H01R 13/62

[52] U.S. Cl. ..... 439/328; 439/157

[58] Field of Search ..... 439/152–160, 439/325–329, 59–62, 631–637

[56] References Cited

U.S. PATENT DOCUMENTS 5,112,242 5/1992 Choy et al. ..... 439/328 X
5,234,354 8/1993 Smart ..... 439/326
5,267,872 12/1993 Gou et al. ..... 439/328 X
5,484,302 1/1996 Yamada et al. ..... 439/326

*Primary Examiner*—Khiem Nguyen
*Attorney, Agent, or Firm*—Silverman, Cass & Singer, Ltd.

[57] ABSTRACT

An electrical connector includes a plurality of contacts, an insulator for receiving the contacts, and guides provided at both ends of the insulator's lengthwise direction. The connector includes push bars inserted in the guides of the insulator, respectively. Each of the push bars has at its one end an anchor portion for engaging a circuit board or a mating connector, an engaging portion at the other end, and a spring piece between the anchor and engaging portions. The connector further includes cams disposed in mounting portions provided at bottoms of the guides at both the ends of the insulator, respectively. Each of the cams has an anchor portion at its one end engageable the engaging portion of the push bar and has a support consisting of pivot pins on the side of the other end for pivotal movement of the cam. The engaging portion of each the push bar is connected to the anchor portion of one of the cams.

7 Claims, 3 Drawing Sheets

ELECTRICAL CONNECTOR

BACKGROUND OF THE INVENTION

This invention relates to an electrical connector for use in desk-top workstations, servers, personal computers and the like, and more particularly to an ejection mechanism for removing a circuit board, a mating connector or the like from a connector.

A prior art connector will be explained herein referring to FIG. 3 illustrating a hitherto used connector 50 and a circuit board 28 in a perspective view. The prior art connector 50 is mainly composed of an insulator 38 and contacts 40 fixed to the insulator 38 by press-fitting or other method. The connector 50 having the contacts fixed thereto is connected to a plug-in circuit plate (not shown) for the connector 50 by soldering. Thereafter, a circuit board 28 or a mating connector is fitted in the connector 50. FIG. 3 illustrates a state that the circuit board 28 is about to be inserted into the connector 50.

Terminal portions 44 of the contacts 40 fixed to the connector 50 are inserted into the plug-in circuit plate (not shown) and then the contacts 40 are soldered therein by reflowing or the like The insulator 38 is provided at both ends of its lengthwise direction with guides 48 which are formed in their insides with insertion grooves 36, respectively, for guiding the circuit board 28 or the mating connector.

For maintenance or when a fault occurs, it may be needed to remove and again insert the circuit board from and into the connector. In order to remove the circuit board 28 from the connector, according to the prior art the circuit board 28 must be grasped by fingers of an operator and then pulled in the x direction in FIG. 3. In such a removal of the circuit board 28 from the connector 50, a great force is required although it may be affected by the number of cores and contact force between the circuit board and the connector. For example, in the case that the number of cores is 168 and the contact force per one core is 100 gf, a removing force more than 3 kg may be necessary.

With an increase in the number of cores, the removing force will proportionally increases. In many cases, a circuit board 28 to be fitted in a connector has precision chips carried thereon. When removing the circuit board from the connector, therefore, an operator generally tend to grasp the circuit board with its part equipped with chips and pull it by a great force more than 3 kg. Consequently, there is a problem to be solved in the prior art that the pulling force and static electricity would damage chips to cause a need for an exchange of high expensive circuit boards themselves, which results in an increase in cost as a whole.

There is a further problem to be solved in the prior art that due to vibration or the like, a circuit board 28 fitted in the connector 50 tends to deviate from its correct position relative to contact portions of contacts 40 of the connector 50 so that stable contact therebetween could not be obtained.

In the event of a great number of cores, moreover, on soldering a comparatively long connector 50 to a plug-in circuit plate, the connector itself is likely to bend slightly so that the connector is partially spaced apart from the plug-in circuit plate to make it impossible to obtain a stable soldered state of the connector.

SUMMARY OF THE INVENTION

In view of the disadvantages of the prior art described above, it is an object of the invention to provide an improved electrical connector capable of removing a circuit board from it without touching the circuit board so that no chips carried on the circuit board are damaged, and further to provide an improved electrical connector which is in stable contact with a plug-in circuit plate.

The above object can be accomplished by the essential features of the invention. According to the invention, each of push bars has at its one end an anchor portion for engaging a circuit board or a mating connector, an engaging portion at the other end, and a spring piece between the anchor and engaging portions. Push bars having such features described above are inserted in guides at both the ends of an insulator, respectively. Each of cams has at its one end an anchor portion engageable the engaging portion of the push bar and has supports at the other end for pivotal movement of the cam. Cams having such features are disposed in mounting portions provided at bottoms of guides at both the ends of the insulator, respectively. The engaging portion of each of the push bars is connected to the anchor portion of one of the cams.

Preferably, the anchor portions of the push bars are curved in the form of a letter "C" and the engaging portions of the push bars are curved in the form of a chevron in section.

In a preferred embodiment, each of the push bars is provided with reinforcing rims formed by bending its integral parts for reinforcing the push bar.

At least one lock pin is provided for mounting the insulator on a plug-in circuit plate.

Each of the push bars is so connected to one of the cams that the cam is rotatable about its support (pivot pins) as a fulcrum by moving the push bar, thereby removing the circuit board or a mating connector from the insulator.

By engagement of the engaging portions 19 of the push bars 10 with the anchor portions 24 of the cams 20, when the push bars 10 are pushed in the direction opposite to the direction x, the cams are pivotally moved about the support 22 (pivot pins) as a fulcrum so that the surfaces 26 of the cams 20 raise the surface 32 of the circuit board 28.

When the push bars 10 are pushed in the direction opposite to the direction x, the spring pieces 15 at the central portions of the push bars 10 deform in the directions parallel to the direction y so that the anchor portions 18 of the push bars 10 are easily disengaged from notches 30 of the circuit board 28.

Since the connector 50 is preliminarily held to the plug-in circuit plate by means of the lock pin or lock pins 52, terminal portions 44 of the contacts 40 of the connector 50 remain inserted uniformly in the plug-in circuit plate.

The electrical connector according to the invention has the subject features described above to bring about the following unique and significant effects.

The combination of the push bars 10 with the cams 20 makes it possible to remove the circuit board 28 from the connector 50 with ease only by pushing the push bars 10 in the direction opposite to the direction x without touching the circuit board 28.

As the circuit board 28 can be removed without touching it, there is no risk of the chips carried on the circuit board 28 being damaged.

The push bars 10 are securely engaged in the notches 30 of the circuit board 28 so that it is prevented from being removed from the connector to achieve a stable connection of contacts.

Although the push bars 10 are securely engaged in the notches 30 of the circuit board 28, it is not scratched by the push bars 10 because of the deformation of the push bars 10 in the directions parallel to the direction y when pushing the push bars 10.

The connector 50 is preliminarily held to the plug-in circuit plate by means of the lock pin or pins 52 so that the connector 50 is prevented from bending or curving to obtain a stable soldered state of the connector 50.

The invention will be more fully understood by referring to the following detailed specification and claims taken in connection with the appended drawings.

BRIEF DESCRIPTION OF THE DRAWINGS

FIG. 2B' is perspective view of a push bar according to another embodiment of the invention;

DESCRIPTION OF THE PREFERRED EMBODIMENTS

Figure 1:
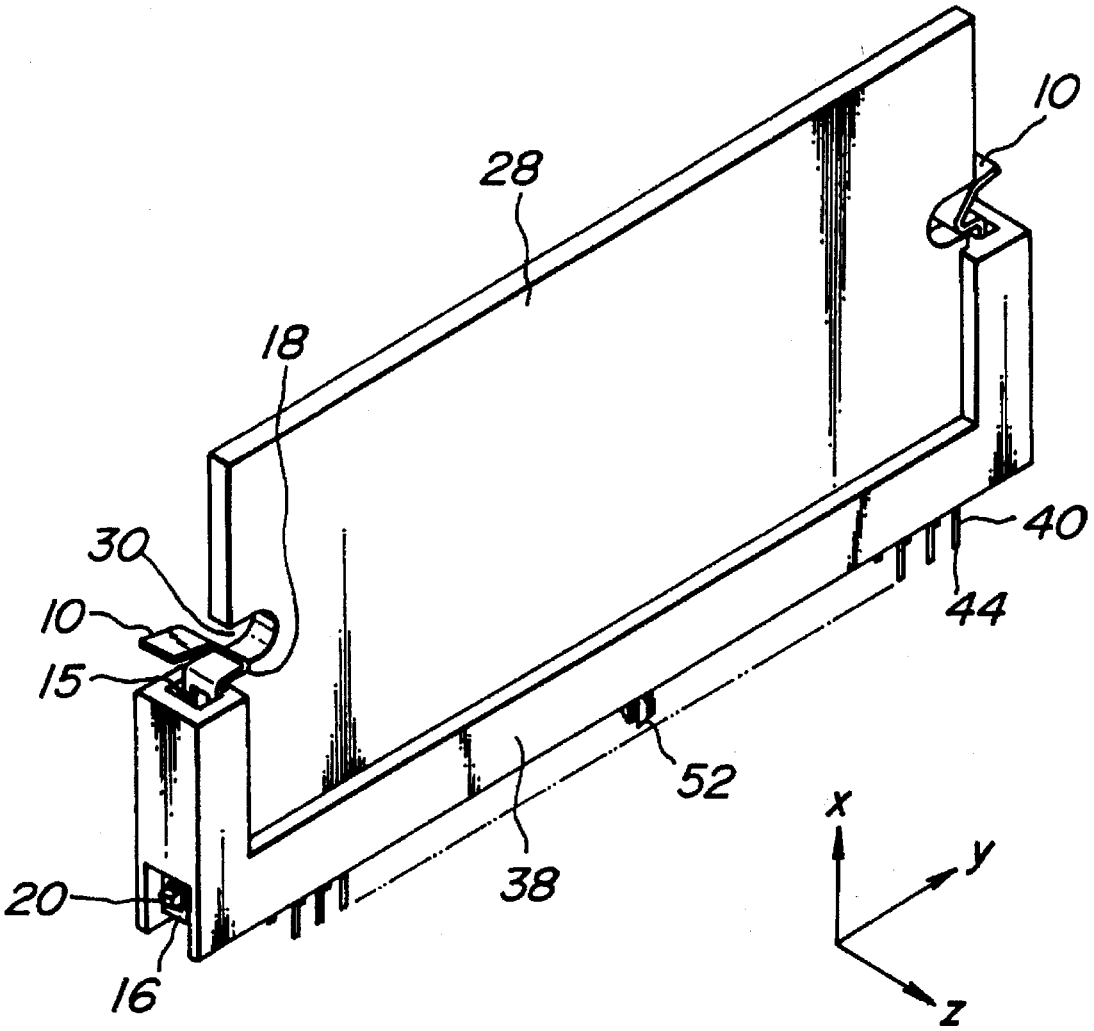
FIG. 1 is a perspective view illustrating a connector having mounted a circuit board thereon using push bars according to the invention.
Figure 2A:
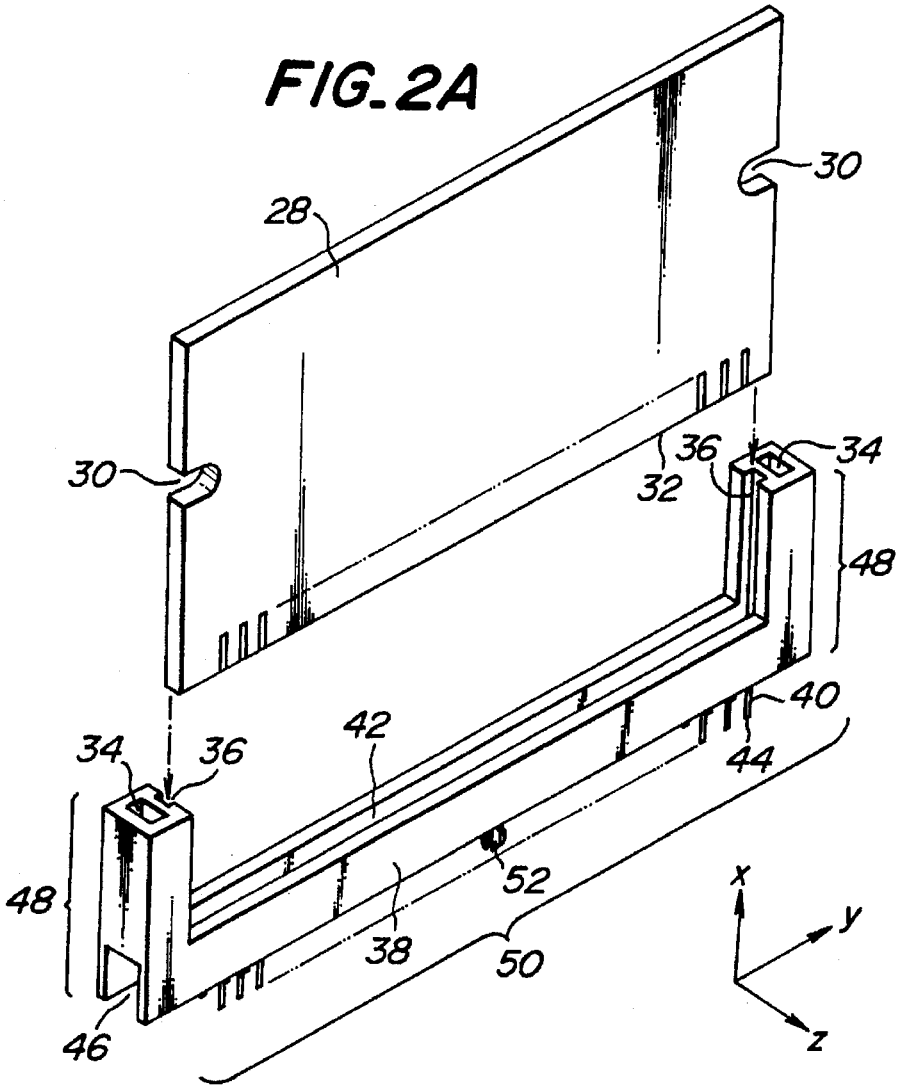
FIG. 2A is a perspective view illustrating the connector and the circuit board before assembling with push bars and cams according to the invention.
Figures 2B, 2C:
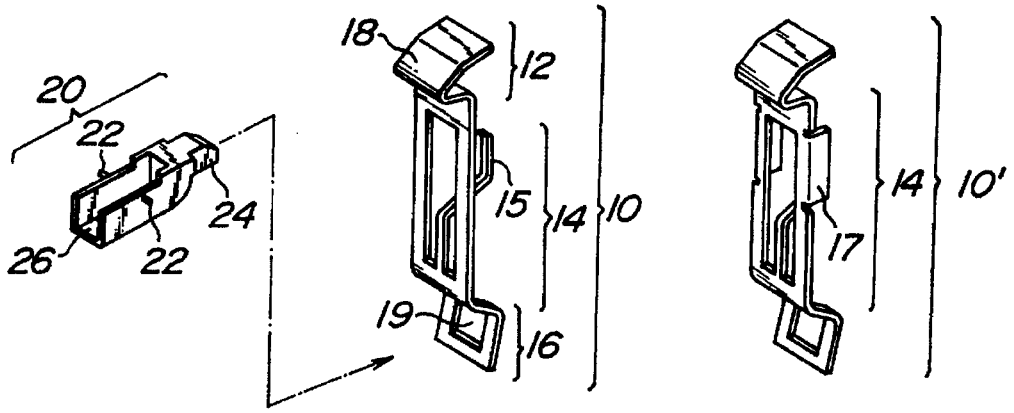
FIG. 2B is a perspective view of a push bar according to one embodiment of the invention.
FIG. 2C is a perspective view of a cam according to one embodiment of the invention.
Figure 3:
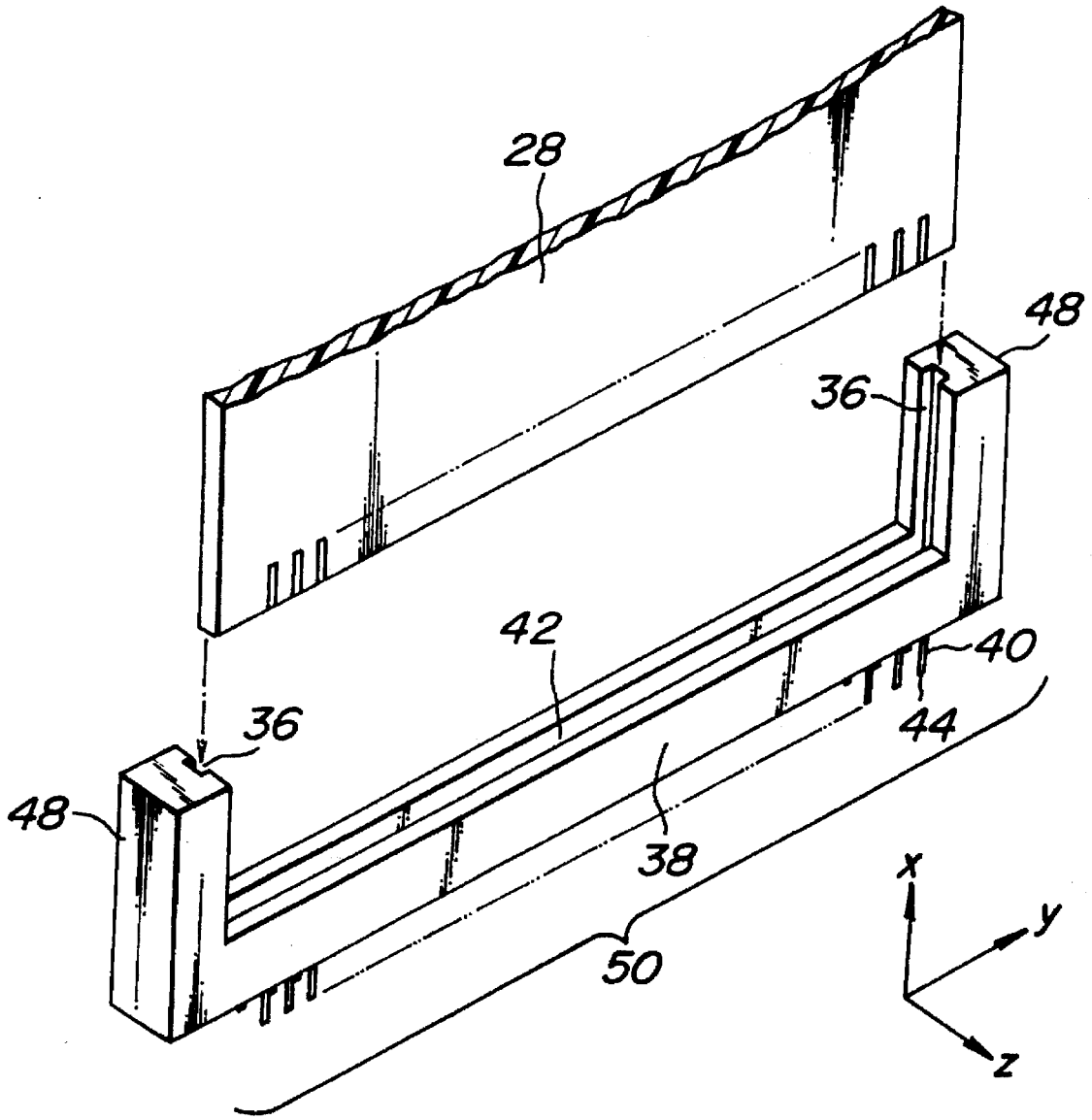
FIG. 3 PRIOR ART
FIG. 3 is a perspective view of a circuit board and a connector according to the prior art.

FIG. 1 is a perspective view illustrating one embodiment of the invention, showing a state of a circuit board 28 fitted on a connector 50 to which is applied push bars 10 according to the invention. FIGS. 2A, 2B, 2B' and **2*c* are perspective views of the connector 50, the push bar 10, a modified push bar 10' and a cam 20** before assembling them, respectively.

The connector 50 is mainly composed of an insulator 38, contacts 40, push bars 10 and cams 20. The insulator 38 is usually formed in a predetermined shape by the injection molding technique from an electrically insulating plastic material.

The insulator 38 of the connector 50 according to the invention includes at its ends guides 48 formed in their insides with insertion grooves 36 for guiding a circuit board 28 or a mating connector (not shown). The insertion grooves 36 have a width substantially equal to, or preferably slightly (the order of 0.05 to 0.1 mm) larger than a thickness of the circuit board 28 or the mating connector for the purpose of guiding them. In forming the insertion grooves 36, however, it is better to allow a play therebetween as little as possible.

Each of the guides 48 is formed with an insertion hole 34 for receiving the push bar 10. The insertion hole 34 has a size to permit the push bar 10 to be inserted thereinto and suitably designed to maintain the strength of the guide. In the shown embodiment, the insertion hole 34 rectangular in section has a size of the order of 2 mm (in the direction y) X 4 mm (in the direction z).

The connector has a size which is suitably designed and determined according to an application or the like. In the shown embodiment, the connector has a length of the order of about 142 mm, a width of the order of about 6 mm and a height of the order of about 18 mm. The length of the connector depends on the pitches of contacts or the number of cores. The width also depends on the pitches of contacts. With the connector of the shown embodiment having the size described above, the number of cores is 168.

Examples of the material for the insulator 38 are generally PBT, PC, PA (nylon 66, nylon 46), PPS, LCP and the like. In case that heat resistance is required, LCP, PPS and nylon 46 may be recommended.

A required number of contacts 40 are fitted and fixed in the insulator 38. Each of the contacts 40 comprises three portions, that is, a contact portion 42 adapted to contact a contact of a mating connector or a connection terminal of the circuit board, a fixed portion to be fixed to the insulator 38, and a terminal portion 44 to be electrically connected to a plug-in circuit plate (not shown).

The contact 40 may be made of an electrically good conductive and rebounding resilient metallic material by punching or the other publicly known method. As a typical method for fitting or fixing the contacts 40, they are press-fitted in contact fixing apertures provided at predetermined positions in the previously formed insulator 38.

As materials for the contacts 40, there are phosphor bronze, beryllium copper, brass, nickel silver, red brass, cadmium copper, Cu—Ni—Sn alloy and the like. The phosphor bronze is preferable because of its springiness which is required for contacts. The phosphor bronze is used for the contacts 40 in the shown embodiment.

At least one lock pin 52 is provided in the insulator 38 in the same manner as the contacts 40. The lock pin 52 has an object to prevent the connector 50 from moving away from the plug-in circuit plate (not shown) when the connector 50 is preliminarily held to the plug-in circuit plate.

While only one lock pin 52 is shown at one position at the center of the connector 50 in the shown embodiment, it will be apparent that any number of lock pins may be provided, so long as the object of the lock pins 52 could be achieved. For example, it is sufficient to provide lock pins 52 at two positions at both the ends, or in addition thereto at the center between the ends. The number of the locations at which the lock pins 52 are provided may be suitably determined depending upon the degree of tendency of the connector 50 to bend or curve. In the shown embodiment, the lock pins are made of the phosphor bronze by punching process or the like.

The push bar 10 which is one of the characterizing features of the invention will be explained referring to FIGS. 2B and 2B'.

The push bar 10 comprises three portions which are a C-shaped curved portion 12 at one end, a curved portion 16 in the form of a chevron in section at the other end, and a central portion 14 having a bent spring piece 15 between the curved portions 12 and 16.

The push bars 10 serve to remove the circuit board 28 or a mating connector from the connector 50 with ease only by pushing the push bars 10 with fingers of an operator without touching the circuit board 28 or a mating connector, and to prevent the circuit board 28 from removing from the connector 50 once it is fitted with the circuit board 28 or the mating connector.

The push bar 10 may be made of a metallic material having a springiness by punching or other publicly known working techniques. As materials for the push bars 10, there are phosphor bronze, beryllium copper, brass, nickel silver, red brass, cadmium copper, Cu—Ni—Sn alloy and the like similar to those for the contacts 40. The Cu—Ni—Sn alloy is preferable because of its springiness and higher strength which are required for the push bars. In the shown embodiment, SUS 304 (stainless steel according to Japanese Industrial Standard) is used.

The push bar 10 is provided at the curved portion 12 with an anchor portion 18 which is preferably curved in the form of a letter "C" as shown in FIGS. 2B and 2B' for the purpose of easily engaging a notch 30 formed in the circuit board 28 and avoiding the circuit board 28 from being scratched by the anchor portion 18. When the anchor portions 18 of the curved portions 12 of the push bars 10 engage the notches of the circuit board 28, the connector 50 and circuit board 28 are securely clamped together so that there cannot be easy accidental dislodgment therebetween.

Although the C-shaped curved anchor portions 18 are shown in the embodiment, it is to be understood that any other shapes of the anchor portions may be used, for example, L-shaped, chevron-shaped, or the like, so long as they can engage the notches 30 of the circuit board 28. The push bar 10 is formed in the curved portion 16 with an engaging portion 19 for engaging a cam 20 shown in FIG. 2C.

While the engaging portion 19 is shown in the form of a chevron in section in the embodiment, it may be formed in any other forms so long as it can be connected to the cam 20. The engaging portion 19 is bent in the form of the chevron as shown in FIG. 2B in order to make it easy to engage the anchor portion 24 of the cam 20 and make it difficult to disengage from the anchor portion 24 and further to achieve easy pivotal movement of the cam 20 connected to the engaging portion 19.

The push bar 10 is provided at its center with a curved spring piece 15 which urges the wall of the insertion hole 34 to prevent the push bar 10 from moving out of the hole 34 once the push bar 10 has been inserted in the insulator 38. Another function of the spring piece 15 is to allow the push bar 10 to deform in the direction y when the circuit board 28 is removed from the connector 50. The spring piece 15 is curved in the form of the letter "S" in the shown embodiment as in FIG. 2B.

The dimension of the push bar 10 may be suitably determined depending upon a size of the insertion hole 36 of the guide 48 in the insulator 38 so as to be inserted into the insertion hole 36. In the shown embodiment, the size is of the order of 21 mm length, 4 mm width and 0.4 mm thickness. The push bar 10 may be inserted into the insertion hole 36 of the guide 48 in the insulator 38 in the direction opposite to the direction x shown in FIG. 2A.

FIG. 2B' illustrates a modified embodiment of the push bar 10. This modified push bar 10 has reinforcing rims 17 on both sides of its central portion 14 to increase its mechanical strength. When the push bar 10 is punched from a blank material, the rims may be simultaneously formed integrally with the push bar itself and then bent at their bottoms substantially at right angles to the central portion 14 as shown in FIG. 2B'.

When the circuit board 28 is to be removed, the anchor portion 18 of the push bar 10 should disengage from the notch 30 of the circuit board 28. In this case, the two push bars 10, 10 are to move apart to widen the interval therebetween. Accordingly, the spring piece 15 is depressed against the inner side wall of the hole 34 of the insulator 38 to deform by the spring force. The reinforcing rim 17 acts also to prevent an excessive deformation amount of the spring piece 15 so as not to exceed its fatigue limit.

The cam 20 which is one of the characterizing features of the invention will be explained referring to FIG. 2C.

The cam 20 comprises a support or a fulcrum consisting of two pivot pins 22, an anchor portion 24 to be engaged with the engaging portion 19 of the push bar 10, and a cam surface 26.

The function of the cam 20 is to move the circuit board 28 away from the connector 50 when the former is removed from the latter. The cams 20 may be inserted in the cam mounting portions 46 provided at the bottoms of the guides 48 either in the direction opposite to the direction x (from the side of contact portions 42 of the contacts 40) or in the directions parallel to the direction y. In the shown embodiment, the connector is constructed so as to permit the cams 20 to be inserted from above as viewed in FIG. 2A or in the direction opposite to the direction x in the drawing.

The cams may be made of either a metallic material or a plastic material. In consideration of economy and workability, a plastic material is used for forming the cams in the shown embodiment. Preferred plastic materials for the cams include those for the insulator 38. The nylon 46 is used for the cams in the shown embodiment.

Any one of the cam 20 and the push bar 10 can be mounted in the insulator 38 prior to the other. After the cam 20 and push bar 10 have been mounted in the insulator 38, the anchor portion 24 of the cam 20 is brought into engagement with the engaging portion 19 of the push bar 10 so that these members are connected.

With this connection of the cams 20 and the push bars 10, when the push bars 10 are pushed toward the insulator 38, the cams 20 are pivotally moved about their fulcrums 22, respectively, so that the cam surfaces 26 of the cams 20 contacting the surface 32 of the circuit board 28 cause the circuit board 28 to move away from the insulator 38, thereby removing the circuit board 28 from the insulator 38 with the aid of the push bars 10 and the cams 20.

While the invention has been particularly shown and described with reference to preferred embodiments thereof, it will be understood by those skilled in the art that the foregoing and other changes in form and details can be made therein without departing from the scope of the claims.

What is claimed is:

1. An electrical connector including a plurality of contacts and an insulator for receiving and fixing said contacts and having guides at both ends of its lengthwise direction, said connector comprising push bars inserted in said guides at both the ends of said insulator, respectively, each of said push bars having at its one end an anchor portion for engaging a circuit board or a mating connector, an engaging portion at the other end, and a spring piece between said anchor and engaging portions, and said connector further comprising cams disposed in mounting portions provided at bottoms of said guides at both the ends of said insulator, respectively, each of said cams having at its one end an anchor portion engageable said engaging portion of said push bar and having a support on the side of the other end for pivotal movement of the cam, said engaging portion of each of the push bars being connected to said anchor portion of one of the cams.

2. The electrical connector as set forth in claim 1, wherein said anchor portions of the push bars are curved in the form of a letter "C".

3. The electrical connector as set forth in claim 1, wherein said engaging portions of the push bars are curved in the form of a chevron in section.

4. The electrical connector as set forth in claim 1, wherein each of said push bars is provided with reinforcing rims formed by bending its integral parts for reinforcing the push bar.

5. The electrical connector as set forth in claim 1, wherein the circuit board or a mating connector is locked to said connector to prevent the former from removing from the latter, when the circuit board or a mating connector is fitted in the connector.

6. The electrical connector as set forth in claim 1, wherein each of said push bars is so connected to one of said cams that the cam is rotatable about said support as a fulcrum by moving said push bar.

7. The electrical connector as set forth in claim 1, wherein at least one lock pin is provided for mounting the insulator on a plug-in circuit plate of the connector.

* * * * *